United States Patent [19]

Haber

[11] 4,103,773

[45] Aug. 1, 1978

[54] COMBINATION PACKAGE AND RACK FOR POOL BALLS

[76] Inventor: Terry M. Haber, 3197 B Airport Loop Dr., Costa Mesa, Calif. 92626

[21] Appl. No.: 857,461

[22] Filed: Dec. 5, 1977

[51] Int. Cl.[2] ..... B65D 85/58

[52] U.S. Cl. ..... 206/315 B; 206/45.14; 206/45.34; 206/579; 211/14; 273/22

[58] Field of Search ..... 211/14, 49 S; 217/26, 217/26.5; 220/307; 206/499, 579, 315 B, 45.14, 45.34; 273/10, 14, 22

[56] References Cited

U.S. PATENT DOCUMENTS

| | | | |
|---|---|---|---|
| 526,554 | 9/1894 | Barnes | 273/14 |
| 1,187,243 | 6/1916 | Bernstein | 273/22 |
| 2,926,809 | 3/1960 | Studler | 211/14 |
| 3,329,258 | 7/1967 | Brown et al. | 206/45.14 |
| 3,802,555 | 4/1974 | Grasty et al. | 206/499 |
| 3,822,781 | 7/1974 | Braginetz | 206/45.34 |

FOREIGN PATENT DOCUMENTS

| | | | |
|---|---|---|---|
| 365,571 | 4/1906 | France | 211/49 S |

*Primary Examiner*—William Price
*Assistant Examiner*—Bruce H. Bernstein
*Attorney, Agent, or Firm*—Ralph B. Pastoriza

[57] ABSTRACT

The packaging includes bottom, intermediate and top trays of triangular outline each having depending flared side walls, the side walls of the top tray extending sufficiently to overlap both the intermediate and bottom trays to provide a stacked array similar to a truncated pyramid. A majority of the pool balls are supported in circular openings in the top surface of the bottom tray, the remaining pool balls forming a smaller triangular array in openings on the top surface of the intermediate tray, the bottom portions of the remaining pool balls nesting between adjacent top portions of the majority of balls. The trays are transparent so that the balls are visible and the intermediate tray can be separated from the top and bottom tray and its depending side walls utilized as a rack for the pool balls.

5 Claims, 7 Drawing Figures

COMBINATION PACKAGE AND RACK FOR POOL BALLS

This invention relates generally to packaging and point-of-sale displays for game balls and more particularly to a combination package and rack for pool balls.

BACKGROUND OF THE INVENTION

In copending patent application Ser. No. 728,498 filed Sept. 28, 1976 by Robert James Chavarria and Clark Berg Foster, there is disclosed a TRANSPARENT GAME BALL such as a pool ball molding apparatus, method and product. Further, in a copending application Ser. No. 857,297 filed Dec. 5, 1977 for SHOCK RESISTANT TRANSPARENT POLYMER SPHERE MOLDING APPARATUS, METHOD AND PRODUCT COMPOSITION by the inventors of this present application there are disclosed improved techniques in the provision of a transparent pool ball. So far as we are aware, the aforementioned copending patent applications constitute the only prior inventions having to do with the manufacture of a transparent pool ball.

The provision of a transparent pool ball provides many advantages in the game of pool, principally the fact that the rate of rotation of the ball can readily be observed because of its transparency and the visibility of a central disc supported therein carrying on its opposite faces the numeral designation of the ball. Because of the uniqueness of the provision of a transparent ball, it would be highly desirable to provide a similarly unique type of packaging therefor.

BRIEF DESCRIPTION OF THE PRESENT INVENTION

Bearing the foregoing in mind, the present invention contemplates just such a unique packaging primarily designed for packaging transparent pool balls which not only effectively displays the balls at the point-of-sale, but in addition is so designed that a portion of the packaging can be utilized as a rack for racking up the pool balls preparatory to playing.

Briefly, the packaging of the invention contemplates the provision of bottom, intermediate and top triangularly shaped trays having depending side walls and arranged to be stacked to provide the general appearance of a truncated pyramid. A majority of the balls are held within openings in the top surface of the bottom tray and the remainder of the balls held in similar openings in the top surface of the intermediate tray. The trays are transparent so that the balls are visible and the intermediate tray is separable from the bottom and top trays so that it can be used to rack up the balls.

BRIEF DESCRIPTION OF THE DRAWINGS

A better understanding of this invention as well as further features and advantages thereof will be evident by now referring to the accompanying drawings in which.

DETAILED DESCRIPTION OF THE PREFERRED EMBODIMENT

Figure 1:
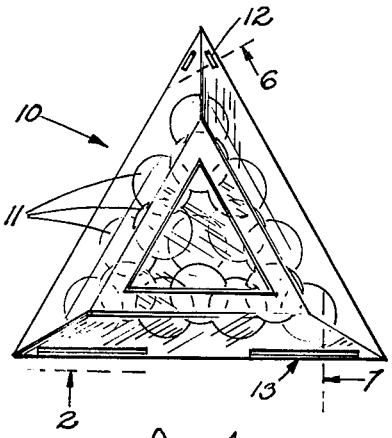
FIG. 1 is a top plan view of the combination package and rack for pool balls in accord with the present invention.
Figure 2:
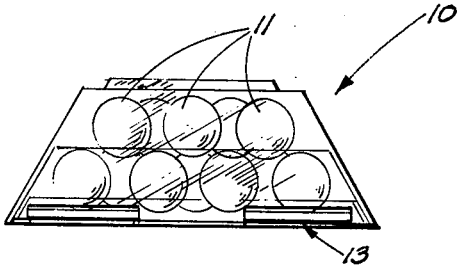
FIG. 2 is a rear elevational view of the packaging of FIG. 1 looking in the direction of the arrow 2.

Referring first to the plan and rear end views of FIGS. 1 and 2, the overall packaging is designated generally by the numeral 10. This packaging is made up of transparent components so that pool balls shown at 11 are visible from the exterior. The overall arrangement resembles that of a truncated pyramid.

As particularly shown in FIG. 1, a front vertex of the overall packaging includes fastening means 12 and along the base line as viewed in FIGS. 1 and 2 hinge means 13. These constructions will be described in greater detail as the description proceeds.

Figure 3:
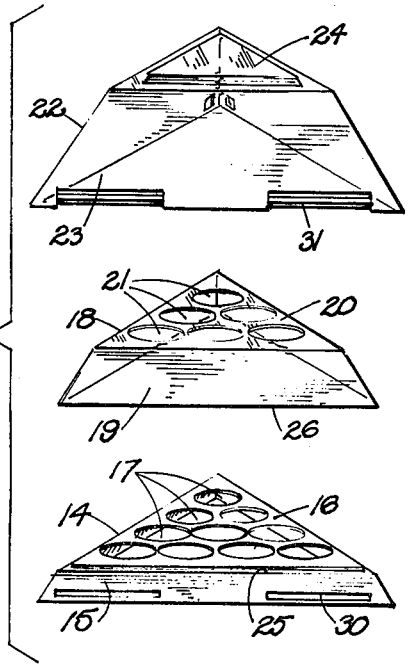
FIG. 3 is an exploded perspective view of the basic components making up the packaging.

Referring now to FIG. 3, details of the packaging described in FIGS. 1 and 2 will be set forth. As shown, the packaging includes a bottom tray 14 having downwardly depending side walls such as indicated at 15 and an upper surface 16 including a first plurality of openings 17. These openings have smaller diameters than the diameters of the pool balls and serve to support a majority of the pool balls respectively. In FIG. 3, the pool balls have been omitted in order to avoid obscuring portions of the structure.

Cooperating with the bottom tray 14 is an intermediate tray 18 having downwardly depending side walls 19 positionable on and supported by the marginal edge of the upper surface of the bottom tray 14. This intermediate tray also includes an upper surface 20 having a second plurality of openings 21 also of smaller diameters than the diameters of pool balls for supporting the remainder of the pool balls.

The packaging assembly is completed by the provision of a top tray 22 as shown in FIG. 3 having downwardly depending side walls 23 of an extent such as to be positionable over both the bottom tray and intermediate tray to cover the same, this top tray having an imperforate upper surface which may include a small raised triangular portion 24 for aesthetic purposes.

Figure 4:
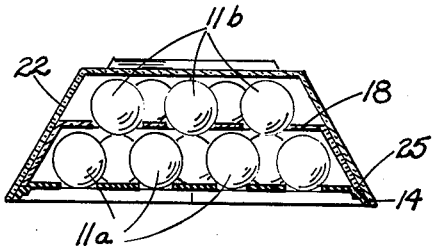
FIG. 4 is a cross section taken immediately in front of the rear wall of FIG. 2.

Referring to the cross section of FIG. 4, the manner in which the intermediate tray 18 seats on the marginal edge of the bottom tray 14 will be evident. Thus, this marginal edge includes a small step 25 about the entire perimeter thereof for receiving the lower edge of the depending walls of the intermediate tray.

Also shown in FIG. 4 is the majority of pool balls at 11a received in the openings of the bottom tray, the remaining pool balls being illustrated at 11b in the openings on the top surface of the intermediate tray.

As will be evident from both FIGS. 1 and 3, the upper surfaces of the bottom, intermediate and top trays are of similar equilateral triangular outline progressively diminishing in size, the side walls of the bottom, intermediate and top trays diverging in a downward direction to provide the heretofore referred to overall shape of a truncated pyramid.

In the case of packaging pool balls, there are provided ten openings in the top surface of the bottom tray for supporting ten pool balls, these openings forming a first equilateral triangular array, and six openings in the top surface of the intermediate tray arranged in a second equilateral triangular array of smaller overall size than the first triangular array. These six openings support the remaining pool balls so that a total of sixteen pool balls are packaged. Fifteen of these balls will have numeral designations and the last will be the cue ball.

From the foregoing geometry, the arrangement is such that when the pool balls are supported in the openings, the lower ends of the remaining pool balls 11b shown in FIG. 4 in the second array nest between the upper ends of the majority of pool balls shown at **11*a* in FIG. 4**.

The dimensioning of the depending walls 19 of the intermediate tray 18 is such that this intermediate tray when separated from the top and bottom trays can function as a pool ball rack for properly positioning the numbered pool balls in a triangular array preparatory to play.

Figure 5:
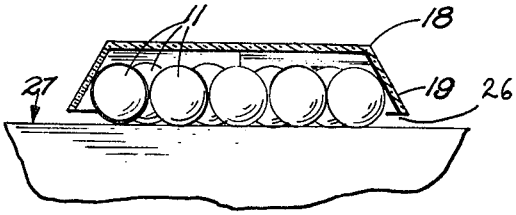
FIG. 5 is a cross section of a portion of the packaging illustrating the manner it is used as a rack for pool balls.

FIG. 5 illustrates the foregoing use of the intermediate tray 18 and it will be noted because of the sloping of the dependent walls 19, and the dimensioning of the overall equilateral triangular outline, intermediate inside wall surfaces of the depending walls 19 engage the balls prior to actual seating of the lower edges of these walls shown at 26 on the pool table surface 27. As a consequence, the balls are cammed into close nesting relationship; that is, in actual physical contact with each other as is desirable in racking the balls.

Referring now to the fragmentary cross section of FIG. 6, the fastening means designated generally by the numeral 12 in FIG. 1 will be described. As shown, this cooperating fastening means includes outwardly biased tabs such as indicated at 28 in FIG. 6 on either side of the vertex of the depending walls of the bottom tray, the depending walls of the top tray including cut-out windows 29 on either side of a corresponding vertex receiving the tabs 28 when the top tray is positioned to cover the intermediate and bottom trays.

Figure 6:
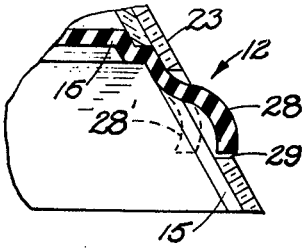
FIG. 6 is an enlarged fragmentary cross section looking in the direction of the arrow 6 of FIG. 1; and, FIG. 7 is another enlarged fragmentary cross section taken in the direction of the arrow 7 of FIG. 1.

With the foregoing arrangement, the top tray can be unfastened from the bottom tray by a person urging inwardly the tabs 28 to the dotted line position 28' shown in FIG. 6 thus disengaging the tab from the window 29 and permitting the top tray to be raised.

Figure 7:
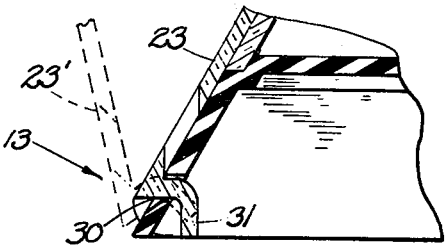

FIG. 7 shows in greater detail the hinge means designated 13 in FIG. 1 provided in the preferred embodiment of the invention so that the top tray can be hinged upwardly about its base line when the tabs 28 are depressed inwardly.

Thus referring specifically to FIG. 7, the straight base wall portion of the bottom tray opposite the one vertex shown in FIG. 1 includes at least one elongated slot 30 running parallel to the lower edge of the base wall, the corresponding portion of the base wall of the top tray including an elongated tongue 31 passing into this slot and thence turning downwardly as shown. An effective hinge arrangement results, the top tray depending rear wall 23 thus being swingable about the hinge as indicated by the phantom line fragmentary showing at 23'.

As described heretofore, the intermediate and top trays are made of transparent plastic material and for convenience in economy of molding, the bottom tray may also be of transparent material, although such is not essential in order to display the balls.

From all of the foregoing, it will be evident that the present invention has provided a unique combination packaging and rack for pool balls not only attractive in overall appearance but so designed as to visibly display the balls and also permit a portion of the packaging structure to be utilized to rack up the balls.

We claim:

1. A combination package and rack for pool balls comprising, in combination:

(a) a bottom tray having downwardly depending side walls and an upper surface including a first plurality of openings of smaller diameters than the diameters of said pool balls for supporting a majority of said pool balls respectively;

(b) an intermediate tray having downwardly depending side walls positionable on and supported by the marginal edge of said upper surface of said bottom tray, said intermediate tray having an upper surface including a second plurality of openings of smaller diameters than the diameters of said pool balls for supporting the remainder of said pool balls; and (c) a top tray having downwardly depending side walls positionable over both said bottom tray and intermediate tray to cover the same and having an imperforate upper surface, adjacent marginal wall portions of said top tray and bottom tray including cooperating fastening means for holding said top tray onto said bottom tray, said downwardly depending side walls of said intermediate tray functioning as a pool ball rack when separated from said top and bottom trays for properly positioning all of said pool balls in a triangular array preparatory to play.

2. The subject matter of claim 1, in which said upper surfaces of said bottom, intermediate and top trays are of similar equilateral triangular outline progressively diminishing in size, the side walls of said bottom, intermediate and top trays diverging in a downward direction so that the overall shape of said package is that of a truncated pyramid.

3. The subject matter of claim 2, in which said first plurality of openings is ten in number arranged in a first equilateral triangular array, said second plurality of openings being six in number arranged in a second equilateral triangular array of smaller overall size than said first triangular array such that when said pool balls are supported in said openings, the lower ends of said remaining pool balls in said second array nest between the upper ends of said majority of pool balls in said first array.

4. The subject matter of claim 3, in which said cooperating fastening means includes outwardly biased tabs on either side of one vertex of the depending walls of said bottom tray, the depending walls of said top tray including cut out windows on either side of a corresponding vertex receiving said tabs when said top tray is positioned to cover said intermediate and bottom trays, the straight base wall portion of said bottom tray opposite said one vertex including at least one elongated slot running parallel to the lower edge of said base wall, the corresponding portion of the base wall of said top tray including an elongated tongue passing into said slot and thence turning downwardly to hinge said top tray to said bottom tray.

5. The subject matter of claim 4, in which at least said intermediate and top trays are made of transparent plastic material so that pool balls supported in said package are visible from the exterior.

* * * * *